US005714709A

United States Patent [19]

Schillinger et al.

[11] Patent Number: 5,714,709

[45] Date of Patent: Feb. 3, 1998

[54] APPARATUS FOR DETONATING A PLURALITY OF OBJECTS

[75] Inventors: Wolfgang Schillinger, Schiltach; Wolfgang Zehnder; Bernd Less, both of Schramberg; Werner Rüdenauer, Roth, all of Germany

[73] Assignee: Gebruder Junghans GmbH, Germany

[21] Appl. No.: 635,491

[22] Filed: Apr. 22, 1996

[30] Foreign Application Priority Data

Apr. 20, 1995 [DE] Germany ..... 195 14 122.9

[51] Int. Cl.[6] ..... F42C 9/00; F42C 15/00

[52] U.S. Cl. ..... 102/276; 102/255; 102/264; 102/403; 89/1.14

[58] Field of Search ..... 102/276, 275.11, 102/264, 255, 293, 403; 89/1.14, 1.11, 1.13; 86/50

[56] References Cited

U.S. PATENT DOCUMENTS

| | | | |
|---|---|---|---|
| 2,433,875 | 1/1948 | Walker et al. | 102/403 |
| 2,546,686 | 3/1951 | Bickel et al. | 102/276 |
| 2,708,409 | 5/1955 | Borcher | 102/276 |
| 3,078,801 | 2/1963 | Rzewinski et al. | 102/276 |
| 3,530,796 | 9/1970 | Kaiser et al. | 102/276 |
| 4,005,631 | 2/1977 | Kaiser et al. | 102/276 |
| 4,007,689 | 2/1977 | Apotheloz | 102/255 |
| 4,957,027 | 9/1990 | Cherry | 89/1.14 |
| 5,162,606 | 11/1992 | Jacob | 102/275.11 |

FOREIGN PATENT DOCUMENTS

| | | | |
|---|---|---|---|
| 89043623 | 8/1991 | Australia | 102/276 |
| 35 44 364 | 6/1987 | Germany . | |
| 33 42 818 | 8/1987 | Germany . | |
| 90 16 841 | 5/1992 | Germany . | |

*Primary Examiner*—Michael J. Carone
*Assistant Examiner*—Theresa M. Wesson
*Attorney, Agent, or Firm*—Burns, Doane, Swecker & Mathis, L.L.P.

[57] ABSTRACT

Objects are detonated by placing charges adjacent respective ones of the objects and connecting the charges to a time fuse by means of respective explosive cords for detonating all of the charges simultaneously when the time fuse fires. The time fuse can be set by fitting a clock to the time fuse. The clock has separate timer mechanisms which can be wound-up simultaneously and which prevent the clock from being fitted to the time fuse if the timer mechanisms have run down asynchronously. An adapter can be attached to the time fuse for releasing a safety of the time fuse upon receiving a remote signal such as an encoded radio signal.

22 Claims, 10 Drawing Sheets

FIG. 4
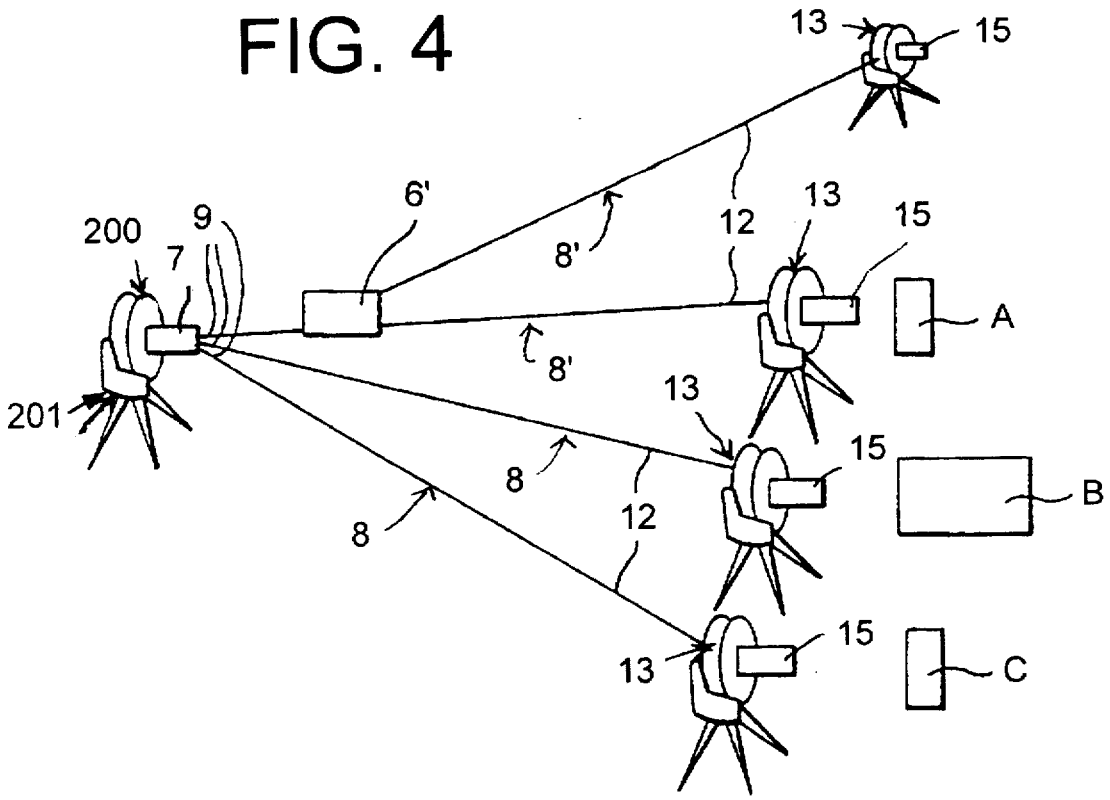
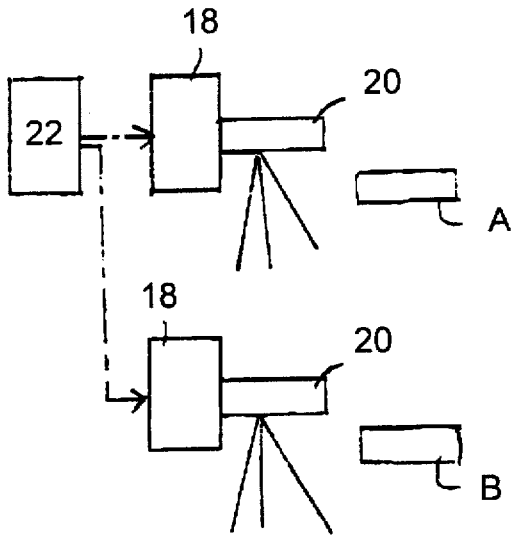
FIG. 5A
PRIOR ART

APPARATUS FOR DETONATING A PLURALITY OF OBJECTS

BACKGROUND OF THE INVENTION

The invention concerns an apparatus for detonating a plurality of objects which are spaced from each other. Such objects may be for example combat munitions such as mortar cartridges, grenades or mines, or dud shots thereof, or also plastic explosive, and cutting and explosive charges.

German Utility Model No. 90 16 841 describes a munitions clearing apparatus (see FIGS. 5A through 9 herein). For exploding a plurality of duds, a time fuse device 18 carrying a charge 20 is disposed adjacent each dud A,B, etc. The time fuse devices are then wound up by means of a central clock 22 so that all time fuse devices fire at the same time, within their running time tolerance. That system requires the use of a plurality of time fuse devices.

DE 33 42 818-C2 describes a circuit arrangement for triggering an explosive charge. Firing is triggered off by means of an optical fiber.

In accordance with DE 35 44 364-A1 a mine is cleared by means of a laser bean.

The object of the present invention is to provide an apparatus with which a plurality of objects can be detonated by means of a single time fuse.

SUMMARY OF THE INVENTION

In accordance with the present invention a time fuse device is connected by pyrotechnic means of different kinds to the objects to be exploded or eliminated, in order thereby to permit a centrally triggered firing which is coordinated in respect of time.

The apparatus comprises a plurality of charges situated adjacent respective ones of the objects to be detonated, a time fuse, a firing distributor connected to the time fuse for transmitting firing signals, and a plurality of explosive cords interconnecting the distributor with respective ones of the charges to ignite the charges simultaneously.

The time fuse preferably includes a first displaceable coupling for setting the time fuse. The apparatus further includes a clock having a housing removably receiving the time fuse, a timer mechanism, and a second displaceable coupling releasably connected to the first coupling. The time fuse and clock are relatively displaceable to cause the time fuse to become wound up. The second coupling is displaceable as the timer mechanism runs down so that the time fuse is set only to the time remaining on the clock from an initially set time thereon.

The time fuse device fires all explosive cords simultaneously by way of the firing distributor so that this accordingly results in simultaneous firing of the objects to which the explosive cords are taken. The structure involved and the firing time adjustment are simple by virtue of the fact that only a single time fuse device is used.

A munitions clearing system of that kind does not involve the use of any electrical components. Therefore no electrical energy supply is required and there is no risk of electromagnetic disturbances.

The described munitions clearing system is safe as preliminary activation occurs and the timing mechanism is activated only by fitting the central clock and setting the fuse device relative to the central clock.

It is advantageous that the central clock can be removed after setting of the fuse device—prior to firing thereof—and can be used for setting further fuse devices. For safety reasons the central clock, while running, cannot be displaced in the opposite direction to the running direction.

The clock preferably includes separate first and second timer mechanisms, a winding up device operably connected to both timer mechanisms for simultaneously winding up both timer mechanisms, and a time comparison mechanism connected to the timer mechanisms for preventing the clock from being mounted to the time fuse if the timer mechanisms run down asynchronously.

The two time mechanisms generally run down uniformly, in which case the central clock can be fitted to a fuse device within the prescribed time. If however one of the time mechanisms is faulty, the two time mechanisms run down in different ways so that in that case the central clock and the fuse device can no longer be fitted together for the time transfer procedure. That considerably enhances the safety factor of the central clock or the safety factor in regard to the transfer of time to the fuse device.

Prior to expiration of the set time the central clock outputs an acoustic signal so that the explosives expert can move to safety. To increase the safety level, the central clock has two alarm mechanisms which can be wound up with the winding device and which output acoustic signals prior to expiry of the set time. If one of the two alarm mechanisms which run down synchronously is at fault, then the explosives expert still receives the necessary warning from the alarm mechanism which is not faulty.

The time fuse may include a releasable safety device for preventing firing of the time fuse. The apparatus further comprises an adapter mountable to the time fuse and including a release device responsive to a remote signal for releasing the safety device.

The time fuse may include a mechanically settable timer mechanism having a manually rotatable setting knob which is rotatable only in a clockwise direction for setting the timer mechanism. The timer mechanism has a predetermined minimum expiration time.

The invention further relates to a method of simultaneously detonating a plurality of spaced apart objects, and also relates to the clock per se having first and second timer mechanisms, as well as to the adapter per se which is responsive to a remote signal for releasing a safety device of a time fuse.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 4 diagrammatically shows the firing distribution system of FIG. 3;

FIG. 5A shows a prior art firing distribution system;

DETAILED DESCRIPTION OF PREFERRED EMBODIMENTS OF THE INVENTION

Figure 1:
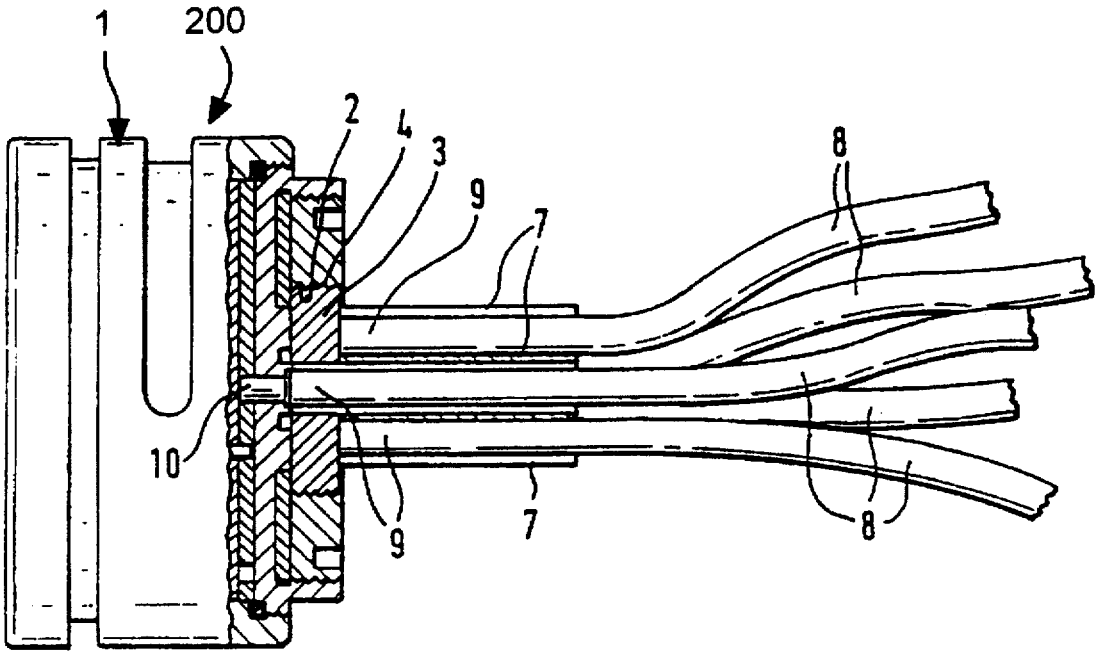
FIG. 1 shows a firing distributor in section with explosive cords on a time fuse device, according to the present invention.

An apparatus 200 depicted in FIG. 1 comprises a time fuse device 1 for setting a firing time, and includes a firing element which is triggered at the firing time.

Figure 2:
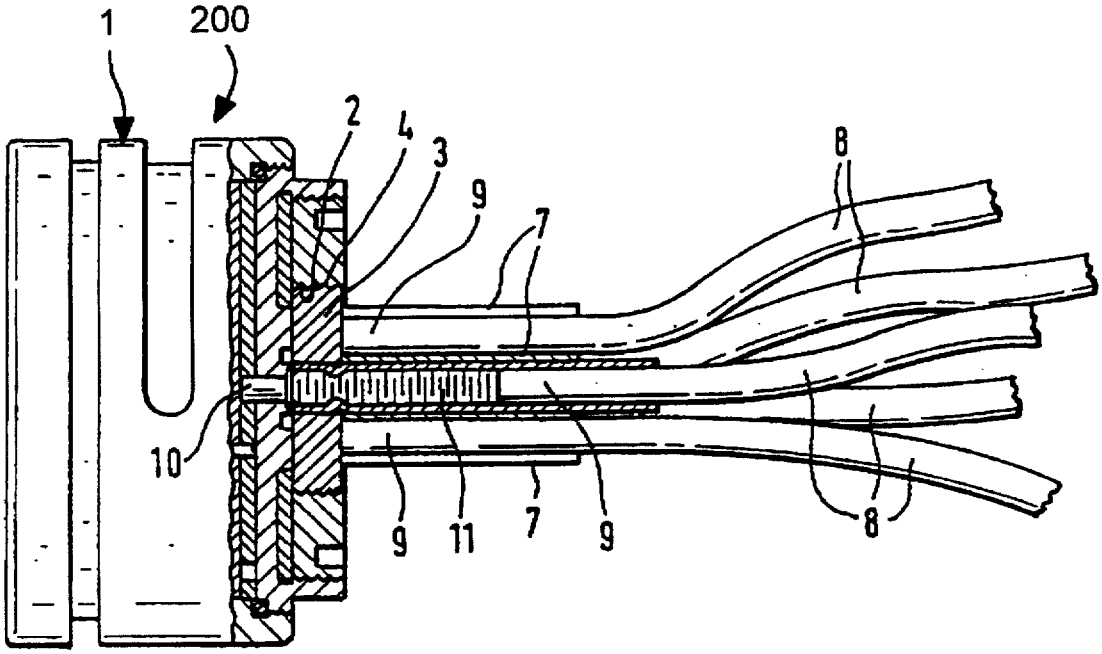
FIG. 2 shows a construction corresponding to FIG. 1 with the addition of a firing booster.

According to the present invention, the apparatus 200 further includes an internal screw thread 2 provided on the time fuse device 1. A firing distributor 3 is screwed into the internal screw thread 2 by means of an external screw thread 4. The firing distributor 3 has a plurality of receiving means 7. The embodiment illustrated has five receiving means 7 of which three are visible in FIGS. 1 and 2. One end 9 of an explosive cord 8 is fitted in frictional engagement into each of the receiving means 7.

Arranged in front of the firing distributor 3 in the time fuse device 1 is a firing socket or sleeve 10. At the time of firing, the firing element of the time fuse device 1 fires the firing socket or sleeve 10 and at the same time, by way of the central explosive cord 8, all further explosive cords 8.

The embodiment shown in FIG. 1 operates without a firing booster. In the embodiment shown in FIG. 2, a firing booster 11 is arranged at the central explosive cord 8 in the receiving means 7 thereof.

The other ends 12 of the explosive cords 8 are adjacent the objects A, B, C to be exploded (see FIG. 4). The other ends 12 of the explosive cords 8 can be used to fire hollow charges, plastic explosive charges or other cutting or explosive charges with or without using plastic explosive, or a firing booster.

Figure 3:
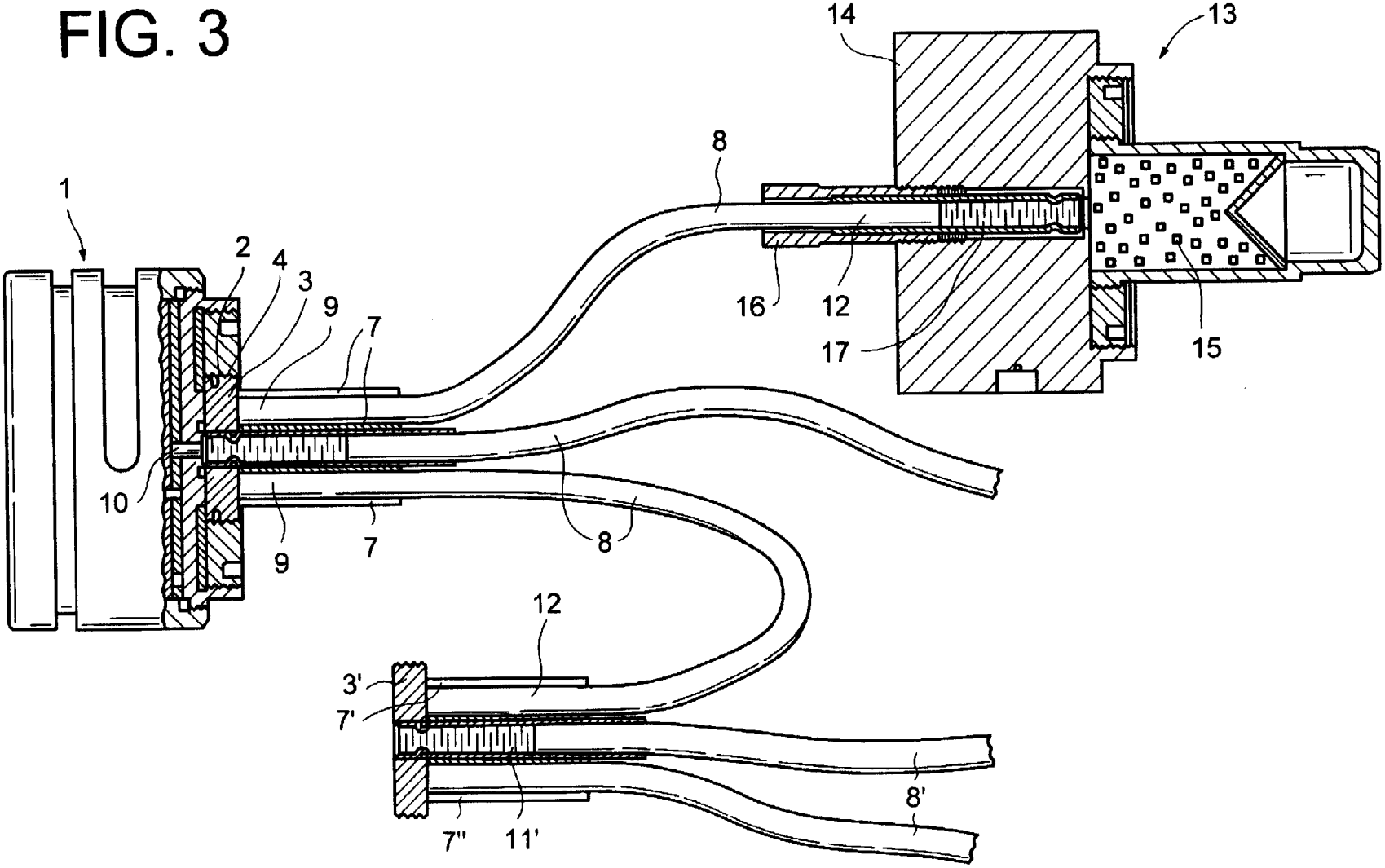
FIG. 3 shows a development of the apparatus in a firing distribution system.
Figure 5:
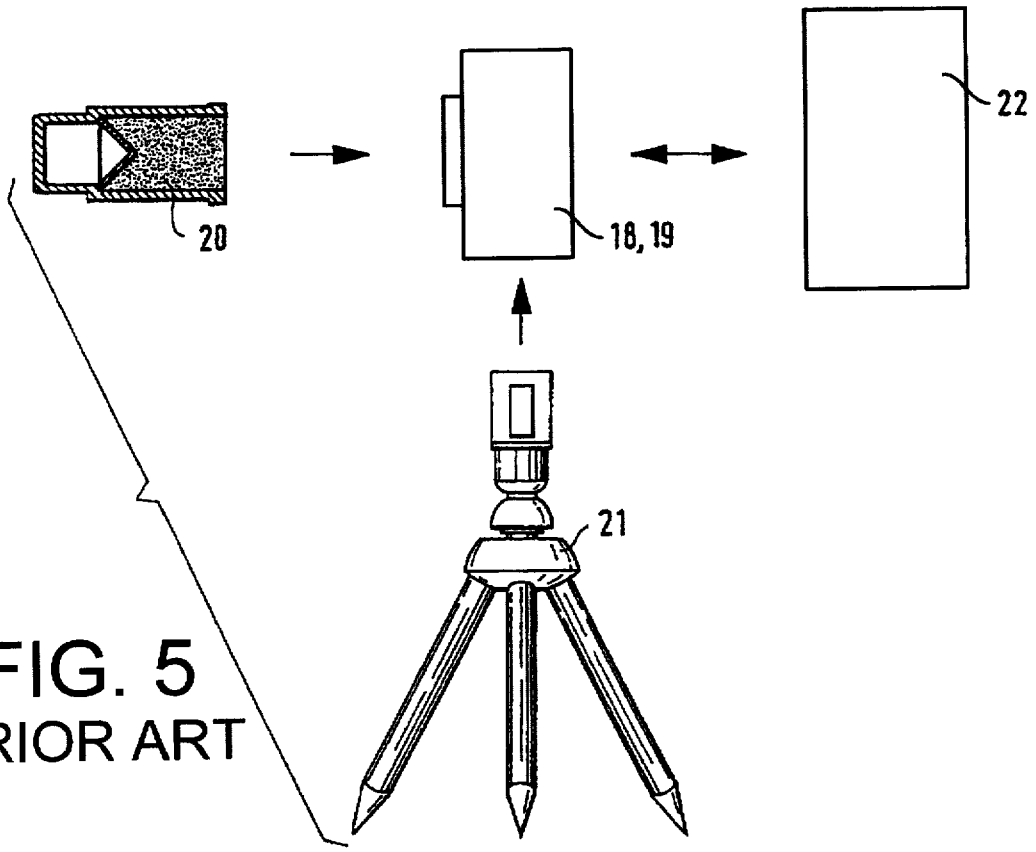
FIG. 5 PRIOR ART
FIG. 5 shows a prior art fuse device with the components, thereof in an exploded state.
Figure 6:
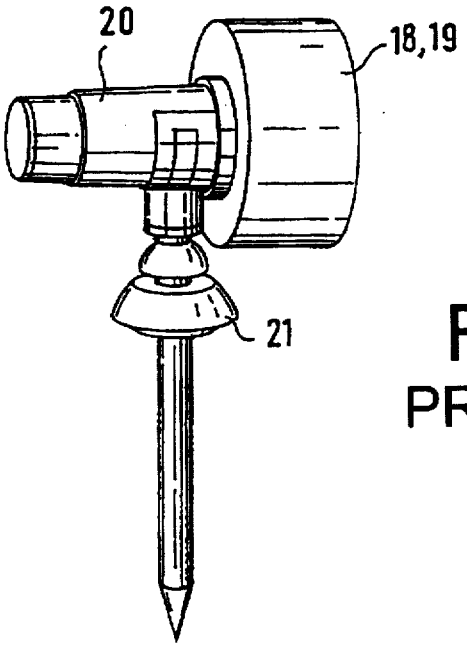
FIG. 6 PRIOR ART
FIG. 6 is a perspective view of the prior art fuse device shown in FIG. 5.
Figure 7:
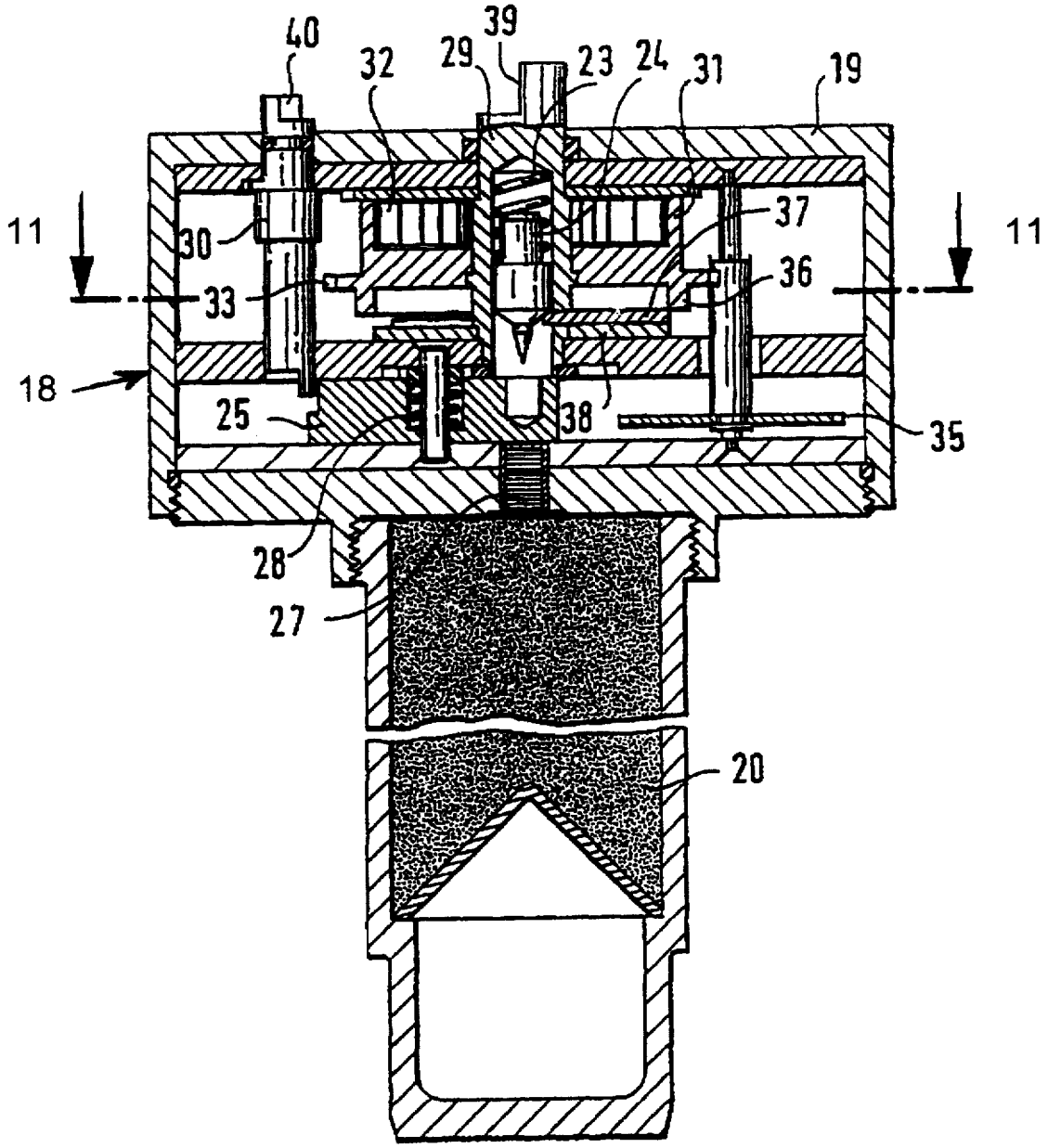
FIG. 7 PRIOR ART
FIG. 7 is a view in section of the prior art fuse device shown in FIG. 5.
Figure 8:
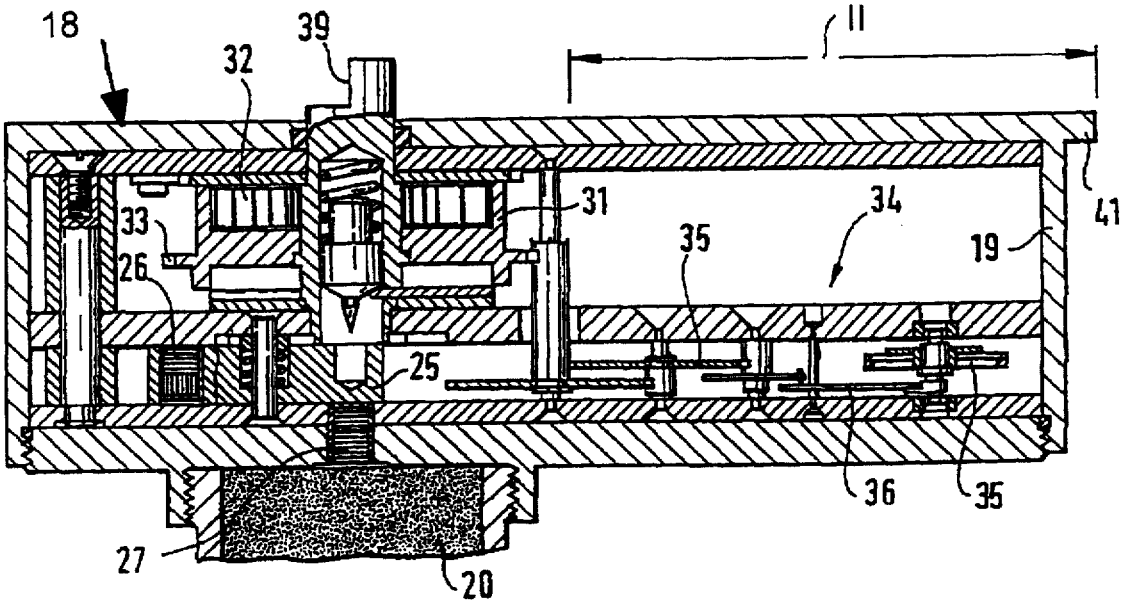
FIG. 8 PRIOR ART
FIG. 8 is a further view in longitudinal section through the prior art fuse device, shown in an extended configuration in the region II, for reasons of enhanced clarity of the drawing.

In the embodiment shown in FIG. 3 a fuse device 13 (dummy) includes a carrier body 14 which carries a hollow charge 15. The end 12 of the explosive cord 8 is fitted in frictional engagement into a firing booster 17 which is screwed by means of a sleeve 16 into the carrier body 14 and with which the hollow charge 15 can be triggered off.

Further distribution of the firing effect is also possible with the described apparatus. For that purpose the end 12 of one of the explosive cords 8 is fitted into the receiving means 7' of a further firing distributor 3'. Fitted into the other receiving means 7" thereof, with or without firing boosters 11', are further firing cords 8'. They can then be used to fire further charges or objects, this being triggered off by the time fuse device 1 (see FIG. 3).

The described apparatus makes it possible by means of a single time fuse device 1 to simultaneously initiate a plurality of explosives involving the same or different conditions.

There may occur a situation where a given terrain has more than one group of adjacent duds A, B, C, whereby it is necessary to form a number of the set-ups shown in FIG. 4, each set-up including a unit 200. It would, however, be desirable that the units 200 of all of those set-ups fire at the same time. In that event, a conventional central clock 22 (FIG. 9) can be employed as a tool for setting all of the time fuses 1. In operation, the conventional central clock 22 (FIG. 9) is firstly wound up manually, for example to 60 minutes, whereupon it begins to run down. Thereafter firstly the first fuse device 1 is fitted to (connected to) the central clock and is set. In that situation the first fuse device is set to the remaining time on the central clock. If, for example, five minutes have elapsed between winding up the central clock and the operation of setting the first fuse device, then the first fuse device is set to 55 minutes. After that, the central clock 22 is removed from the first fuse device and connected to a second fuse device identical to the first fuse device 1 (but not shown) to set the latter. If, for example, a further 10 minutes have elapsed by the time of that operation, then the second fuse device is set to 45 minutes.

In good time before the expiration of the time originally set at the central clock, the central clock produces an acoustic signal so that the explosives expert can take up a position of safety. After the expiration of the relevant time, the fuse devices then fire the dud shots, at the same predetermined time.

The time fuse 1 operates under principles similar to the prior art fuse device 18 shown in FIGS. 5–8. That fuse device 18 has a housing 19 to which a hollow charge 20 is fixed. The fuse device 18 can be fixed on a support stand 21. The central clock 22 can be coupled to the fuse device 18.

Disposed in the housing 19 as a firing chain is a firing needle 24 which is loaded by a spring 23, and provided in a rotor 25 is a detonator 26 as well as a firing transfer means 27 associated with the hollow charge 20. The rotor 25, which is provided as a safety means, is engaged by a torsion spring 28 whose other end is arranged at a winding-up wheel. A shaft 29 is rotatably mounted in the housing 19. A rotatable safety pin 30 is provided for safeguarding the rotor 25.

Fixed to the shaft 29 is a spring drum 31 which is engaged by a spiral spring 32 which is fixed to the shaft 29. Provided externally on the spring drum 31 is a tooth arrangement 33 into which a time mechanism 34 engages. The time mechanism 34 has a plurality of drivingly coupled wheels 35 and an anchor or lever escapement 36. Coupled to one of the wheels 35 is a locking segment which, with a projection, engages the rotor 25. The locking segment is so designed that it releases the rotor 25 about 5 to 10 minutes prior to firing.

A rim 36 having a drop-in slot is provided on the spring drum 31. Associated with the slot is a drop-in lever which retains a triggering lever 37. The triggering lever 37 and the drop-in lever are mounted on a setting disc 38. In the illustrated position, the triggering lever 37 retains the firing needle 24. When the drop-in slot reaches the drop-in lever, the drop-in lever pivots into the slot and thereby releases the triggering lever 37 so that the firing needle is then free.

At its end which projects beyond the housing 19 the shaft 29 is provided with a profile 39 serving as a coupling means. The safety pin 30 has a similar profile 40. An abutment 41 is provided on the housing 19, as a coupling means.

Figure 9:
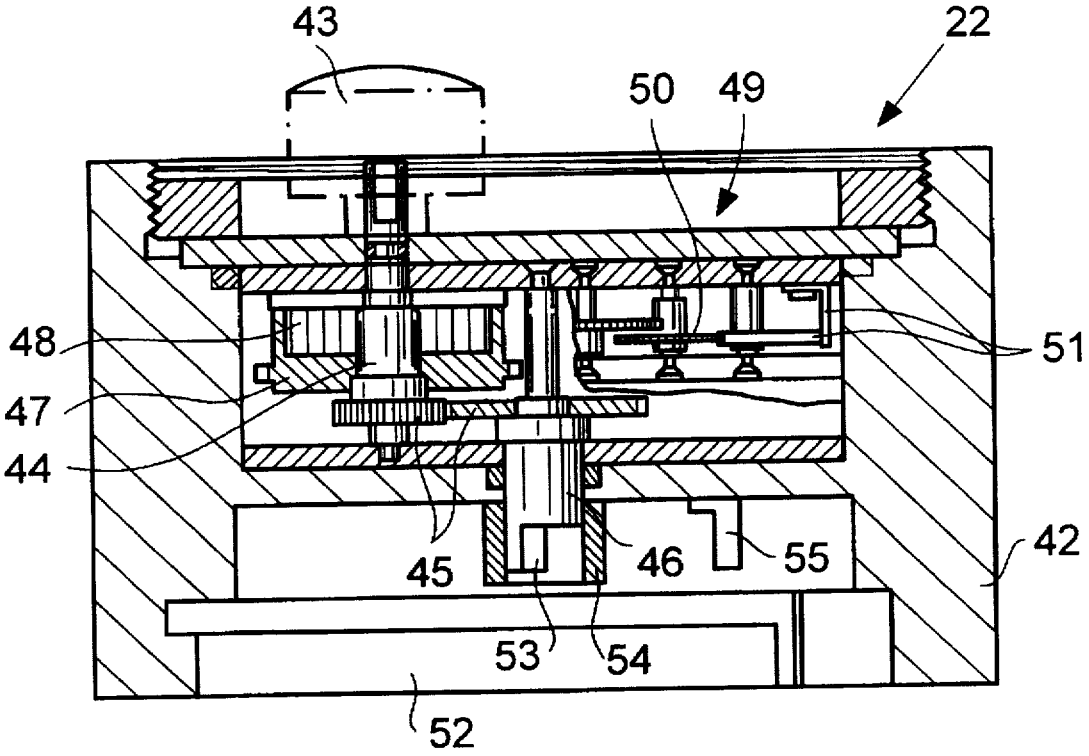
FIG. 9 PRIOR ART
FIG. 9 is a view in section of a prior art central clock.

As shown in FIG. 9, the conventional central clock 22 has a housing 42. Mounted on the housing is a winding-up shaft 44 which carries a winding-up knob 43. The winding-up shaft 44 engages a coupling shaft 46 by way of gears 45. A spring drum 47 with a spiral spring 48 is arranged on the winding-up shaft 44. The spring drum 47 is coupled by way of a tooth arrangement to a time mechanism 49 which has wheels and an anchor or lever escapement. An acoustic signal-generating device 51 can be actuated by means of a further wheel assembly 50.

Provided on the housing 42 is an insertion or push-in space 52 for the fuse device 18. The coupling shaft 46 projects into the insertion space 52, the end of the coupling shaft 46 being provided with a segment 53, corresponding to the profile 39. In the insertion space 52 the coupling shaft 46 is surrounded by a guide sleeve 54. Also projecting into the insertion space 52 is a peg or projection 55 which faces towards the profile 40 of the securing pin 30.

Figure 10:
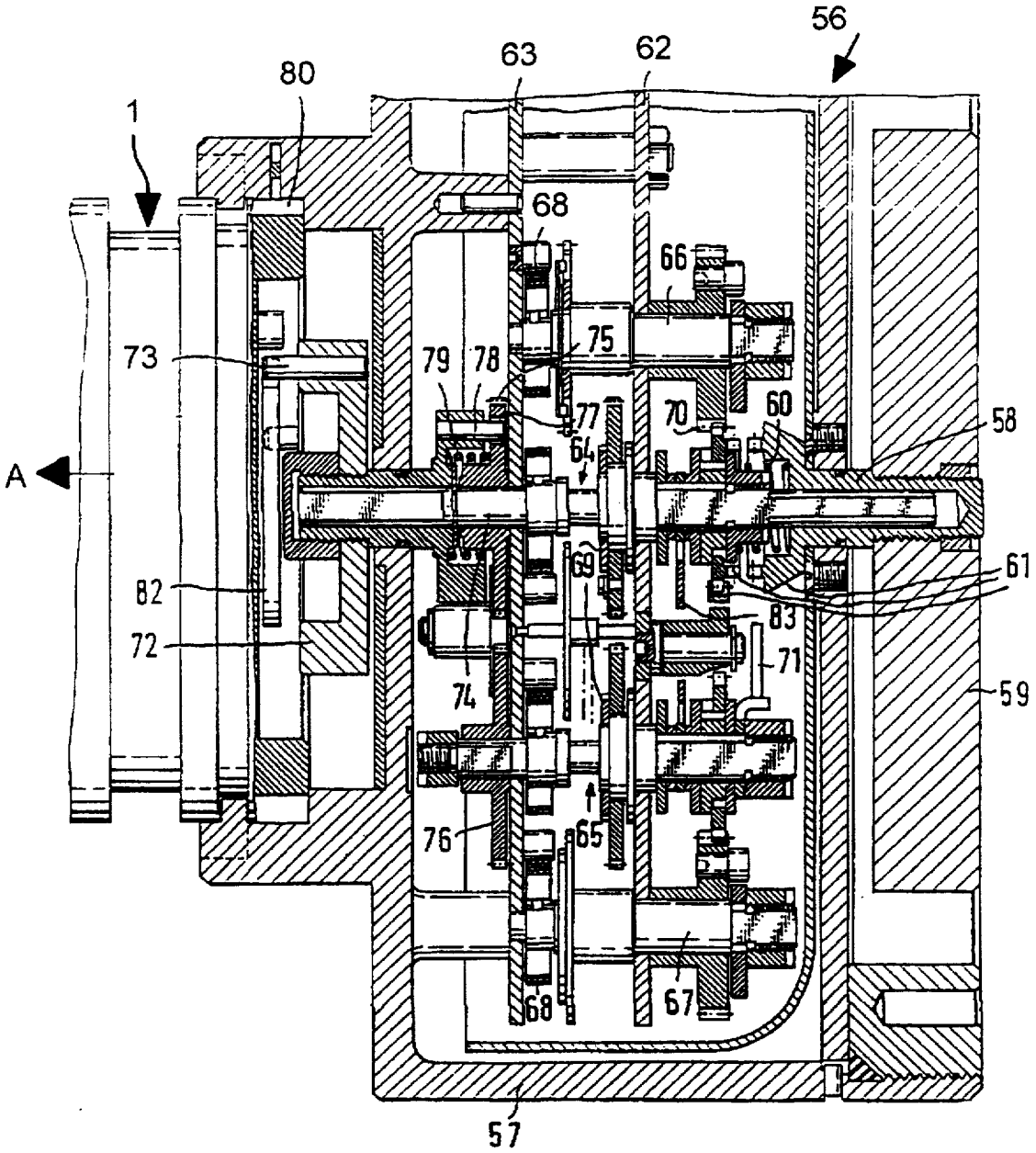
FIG. 10 is a view in section of a central clock with fuse device fitted thereto, according to the present invention.

An improved central clock 56 according to the present invention is shown in FIG. 10.

That central clock includes a winding-up toggle or bar 59 arranged on a winding-up shaft 58 supported in the housing 57 of the central clock 56. The winding-up toggle or bar 59 and therewith the winding-up shaft 58 can be pressed in against the force of a spring 60 in order to bring a winding-up transmission 61 into a condition of engagement.

Mounted in the housing 57 on plates 62, 63 are two separate mechanical time mechanisms 64, 65 and two mechanical alarm mechanisms 66, 67. Each time mechanism has winding-up springs 68 and spring locking devices 69. A winding-up locking device 70 is provided on the winding-up transmission 61.

By rotating the winding-up toggle or bar 59 when it is pressed in, the time mechanisms 64, 65 are simultaneously wound up, to correspond to a desired time. In that case the alarm mechanisms 66, 67 are also wound up. In that situation the spring locking devices 69 prevent the time mechanisms 64, 65 and the alarm mechanisms 66, 67 from running back in the opposite direction. The winding-up locking device 70 is for example a ball-clamp locking device which serves only for winding up the time mechanisms 64, 65 and the alarm mechanisms 66, 67 but which does not have any other function. By virtue of the winding-up toggle or bar 59 being rotated to and from a plurality of times, the winding-up locking device 70 permits the central clock to be fully wound up without the winding-up transmission 61 being disengaged.

After the desired time has been set, the winding-up toggle or bar 59 is released. It is then urged back into its initial position by the spring 60. When that happens, a winding-up repeat-lock 71 which prevents repeated winding-up comes into engagement so that it is no longer possible for the time mechanisms 64, 65 to be further wound up. Repeated winding-up of the arrangement can be effected only when the central clock 56 has run down. This increases the safety factor for the user as further times cannot be subsequently added on. By virtue of that arrangement, in the final result, all fuse devices which are set with the central clock are triggered off at the same time.

Rotatably mounted on a shaft 74 of the time mechanism 64 is a bush on which a fuse-setting disc 72 is fixed by means of a cap nut, the disc 72 carrying a fuse-setting pin 73.

Rotatably mounted on the shaft 74 is a comparison wheel 75 which at its outside periphery is driven by a gear 76 of the time mechanism 65. The comparison wheel 75 has a bore or opening 77 with which there is associated a pin 78 which is arranged on the bush. As long as no fuse device is fitted to the central clock, the pin 78 is disposed outside the bore 77 because a spring 79 urges the bush axially away from the comparison wheel 75.

In the part extending around the fuse-setting disc 72, the housing 57 has a receiving means 80 for a fuse device 1.

After the time mechanisms have been wound up, they are intended to run down synchronously. When that happens, the shaft 74 with the bush and the fuse-setting disc 72 are rotated by the time mechanism 64. The comparison wheel 75 is rotated by the time mechanism 65 by way of the gear 76 so that the pin 78 and the bore 77 are disposed opposite each other while the systems synchronously run down. The bore 77 and/or the pin 78 are of such dimensions that, with an acceptable tolerance between the time expiration of the time mechanism 64 and that of the time mechanism 65, the pin 78 is still disposed opposite the bore 77 in such a way that it can engage into same. If one of the time mechanisms is defective, then synchronous movement of the pin with respect to the bore is no longer guaranteed so that the pin is no longer disposed opposite the bore in such a way that it can engage into same. The described arrangement forms a time-comparison means for comparing the way in which the two time mechanisms 64, 65 run down.

Whenever the receiving means 80 of the central clock is fitted onto a fuse device 1 of FIG. 4 or a fuse device 18 of FIG. 5A, in the direction of the arrow A, a winding-up disc 82 of the fuse device 1 presses against the force of the spring 79 onto the cap nut and engages the fuse-setting pin 73. If the pin 78 of the bush is aligned with the bore 77 in the comparison wheel 75, then the fuse device 1 can be locked in the receiving means 80 and then its time fuse can be wound up by way of the winding-up disc 82. If, however, asynchronous operation of the time mechanisms 64, 65 has occurred, then the pin 78 is not disposed opposite the bore 77, so it cannot engage into the bore 77 to enable the fuse device 1 to be wound up. That therefore ensures that the fuse device 1 cannot be wound up to an incorrect time.

Some minutes prior to the expiration of the time which has been preselected by means of the winding-up toggle or bar 59, the two alarm mechanisms 66, 67 respond in parallel and produce acoustic signals. If one of the alarm mechanisms 66, 67 is faulty, then the signal is produced by way of the other alarm mechanism. When that safety time is reached, in that situation an advance lever 83 is pivoted by way of a switching disc, whereby both alarm mechanisms 66, 67 are triggered off.

Figure 11:
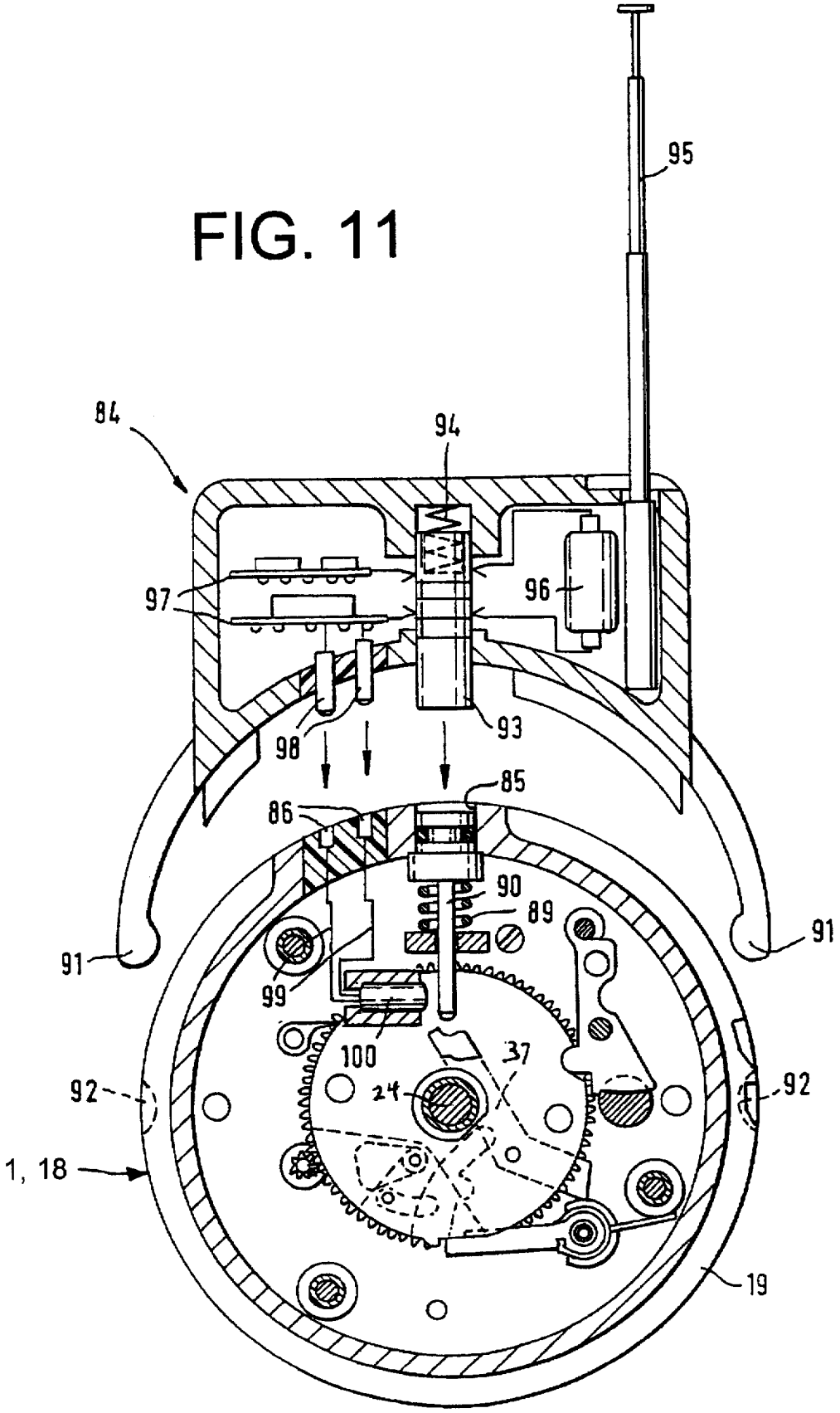
FIG. 11 shows an adaptor according to the present invention in combination with a prior art fuse device shown in section along line 11—11 in FIG. 7.

FIG. 11 is a diagrammatic view in section of an adaptor 84 that involves a further improvement for the prior art fuse device 1 or 18 when installed on the central clock 56. The fuse device 18 in FIG. 11 is a view in section taken along line 11—11 in FIG. 7 and has a housing 19 of circular cross-section, which has a radial through opening 85 and two further juxtaposed bores 86. Disposed in the center of the fuse device 18 is the firing needle lever 37 which, in the illustrated position, holds the firing needle 24 of the fuse device 18 in a safe position. The position of the firing needle lever 37 is ensured by virtue of the fact that a blocking unit comprising a pin 90 subjected to the force of a spring 89 acts on the firing needle lever 37. That action is produced by virtue of the fact that the adaptor 84 is fitted onto the housing 19 of the fuse device 18 and snaps by means of tongues 91 into appropriate openings 92 formed in the housing 19. A push rod 93 of the adaptor acts on the pin 90 under the force of a spring 94.

In the case of a remote encoded signal, which is received by way of the antenna 95, from an external signal generator which can be operated manually by an operator, a capacitor 96 for example is activated in the adaptor 84 so that the push rod 93 is raised out of its contact position, from the pin 90. By the force of the spring 89, the pin 90 is moved out of its engagement position with the firing needle lever 37 so that the firing needle 24 comes into operation and finally triggers off firing.

In addition or alternatively, it is possible to provide, in relation to the push rod 93, a switch unit 97 which is connected to the capacitor 96 and whose plug pins 98 project into the openings 86 in the housing of the fuse device 18 and are there connected by electric lines 99 to a charge 100. In the event of reception of a signal and evaluation, the charge 100 is fired by way of the switch unit 97, whereby the pin 90 is broken or urged laterally out of its condition of engagement with the firing needle lever 37. As a result, in this case also, the firing needle 24 is released.

With the above-indicated radio adaptor, intervention in the function of the fuse device 18 occurs only when the firing time has been set by the central clock 56 and is mechanically running through. In the meantime, the fuse device 18 has been oriented with the object to be exploded, and the radio adaptor 84 has been fitted onto the fuse device 18. The adaptor 84 is supplied with energy (switch) and blocks the firing needle lever 37 by way of the above-described blocking unit. When the mechanically set time has expired, the rotor is in the live or armed position, in relation to the firing needle 24. The firing needle lever 37 still remains blocked. Triggering of the firing needle lever 37 is effected by way of an encoded signal in the above-described electrical or mechanical manner so that finally the detonator of the fuse device 18 is caused to fire. If the adaptor 84 is not used, then after the mechanically set time has expired, the arrangement will automatically provide for triggering and thus firing of the detonator in the original manner.

Figure 12:
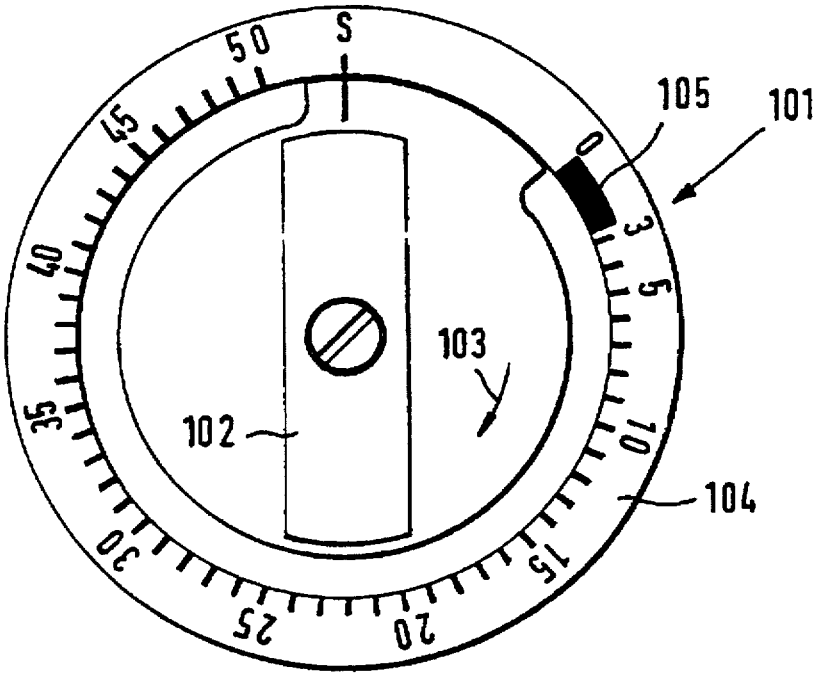
FIG. 12 is a plan view of a mechanical timer with time disc, according to the present invention.
Figure 13:
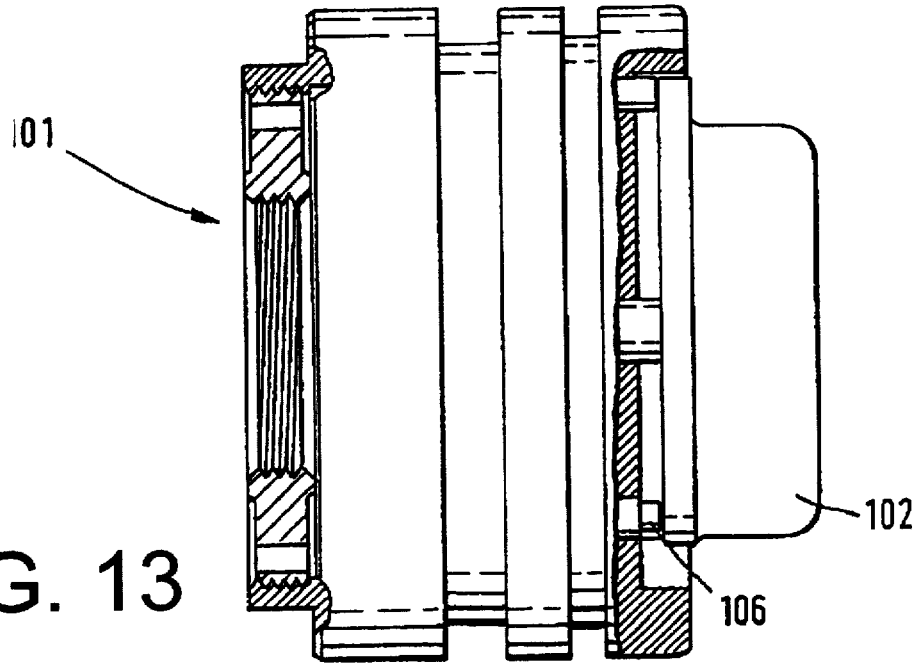
FIG. 13 is a partly sectional side view of the timer shown in FIG. 12.

Instead of the central clock 56, there is also the possibility of the fuse device 18 being provided with a manually settable time fuse 101 (see FIGS. 12–13). This simple time fuse 101 essentially comprises a rotary knob 102 which can be moved only in the direction of the arrow 103, that is to say the usual clockwise direction of rotation of the hand of a clock. It is not possible for the rotary knob 102 to be manually moved opposite to the direction of rotation 103. That reverse direction of rotation is produced exclusively by the clock mechanism of the time fuse 101, as the time goes by. The set time and thus the passage of time is indicated at 103. From the point of view of the viewer and the operator, the position of the rotary knob 102 and thus the time that still remains until triggering of firing occurs are clearly visible, by means of the time disc 104. The function of the time fuse 101 comes into effect only when a predetermined minimum time within the block 105 is exceeded. This time fuse 101 permits individual evaluation of triggerings of firings for eliminating objects (munitions clearing device) while multiple evaluation can be effected in principle when using the central clock 56.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. Apparatus for detonating a plurality of spaced apart objects, comprising:

a plurality of charges situated adjacent respective ones of the objects to be detonated;

a time fuse including a first displaceable coupling for setting the time fuse;

a firing distributor connected to the time fuse for transmitting firing signals;

a plurality of explosive cords interconnecting the distributor with respective ones of the charges to ignite the charges simultaneously;

a clock having a housing removably receiving the time fuse, a second displaceable coupling releasably connected to the first coupling, and a timer mechanism;

the time fuse and clock being relatively displaceable to cause the time fuse to become would up;

the second coupling being displaceable as the timer mechanism runs down so that the time fuse is set only to the time remaining on the clock from an initially set time thereon.

2. The apparatus according to claim 1, wherein the firing distributor is connected by screw threads to the time fuse.

3. The apparatus according to claim 1, wherein at least one cord includes a firing booster connected to the firing distributor.

4. The apparatus according to claim 1, wherein at least one cord includes a firing booster connected to a respective charge.

5. The apparatus according to claim 1, wherein the firing distributor constitutes a first firing distributor, and further including a second firing distributor connected to the first firing distributor and connected to a plurality of charges by respective cords.

6. The apparatus according to claim 1, wherein the charges are mounted on respective carrier bodies which receive ends of respective ones of the cords.

7. The apparatus according to claim 1, wherein the clock includes a signal generator which outputs a signal prior to the expiration of the initially set time.

8. The apparatus according to claim 1, wherein the clock includes separate first and second timer mechanisms, a winding-up device operably connected to both timer mechanisms for simultaneously winding up both timer mechanisms, and a time comparison mechanism connected to the timer mechanisms for preventing the clock from being mounted to the time fuse if the timer mechanisms run down asynchronously.

9. The apparatus according to claim 8, wherein the comparison mechanism includes a pin driven by the first timer mechanism, and a comparison wheel driven by the second timer mechanism, the comparison wheel having an opening arranged to be aligned with the pin when the timer mechanisms run down synchronously.

10. The apparatus according to claim 9, wherein the pin and comparison wheel are arranged to approach one another when the clock is mounted to the time fuse.

11. The apparatus according to claim 1, wherein the time fuse includes a releasable safety device for preventing firing of the time fuse, the apparatus further comprising an adaptor mountable to the time fuse and including a release device responsive to a remote signal for releasing the safety device.

12. The apparatus according to claim 11, wherein the release device comprises a mechanical member.

13. The apparatus according to claim 11, wherein the release device comprises an electrically detonable charge.

14. The apparatus according to claim 13, wherein the release device comprises a mechanical member operable separately of the charge.

15. The apparatus according to claim 11, wherein the adaptor includes a signal receiver for receiving an infra-red signal.

16. The apparatus according to claim 11, wherein the adaptor includes a signal receiver for receiving an ultrasonic signal.

17. The apparatus according to claim 11, wherein the adaptor includes a signal receiver for receiving an encoded radio signal.

18. The apparatus according to claim 1, wherein the time fuse includes a mechanically settable timer mechanism having a manually rotatable setting knob rotatable only in a clockwise direction for setting the timer mechanism.

19. The apparatus according to claim 18, wherein the timer mechanism has a predetermined minimum expiration time.

20. A method of simultaneously detonating first and second groups of spaced apart objects, comprising the steps of:

A) placing first charges adjacent respective ones of the first group of objects;

B) interconnecting the first charges with a first time fuse by means of respective explosive first cords by attaching one end of each first cord to a first distributor of the first time fuse, and attaching another end of each first cord to a respective first charge;

C) fitting a clock to the first time fuse and setting a detonation time period therein;

D) placing second charges adjacent respective ones of the second group of objects;

E) interconnecting the additional second charges with a second time fuse by means of respective explosive second cords by attaching one end of each second cord to a second distributor of the second time fuse, and attaching another end of each second cord to one of the second charges;

F) fitting the clock to the second time fuse subsequent to step C and setting a fuse detonation time period therein corresponding to the time period of step C minus the time which has expired on the clock subsequent to step C; and G) whereby the first and second time fuses fire and energize all of the first and second cords simultaneously.

21. A clock releasably mountable on a time fuse for setting the time fuse, the clock including separate first and second timer mechanisms, a wind-up device operably connected to both timer mechanisms for simultaneously winding up both timer mechanisms, and a time comparison mechanism connected to the timer mechanisms for preventing the clock from being mounted to the time use if the timer mechanisms run down asynchronously.

22. In combination, a time fuse and an adaptor mountable to the time fuse, the time fuse including a releasable safety device for preventing firing of the timer fuse, the adaptor including a release device responsive to a remote signal for releasing the safety device.

* * * * *